US011125395B2

(12) United States Patent
Parker et al.

(10) Patent No.: US 11,125,395 B2
(45) Date of Patent: Sep. 21, 2021

(54) LIGHTING SYSTEM PROVIDING COMBINED DIRECTIONAL AND AMBIENT LIGHT

(71) Applicant: LUMINII LLC, Niles, IL (US)

(72) Inventors: Jeffery Parker, Northfield, IL (US); Laurentiu Vlad, Northfield, IL (US); Meng Yang, Buffalo Grove, IL (US); Sergey Lagonsky, Grayslake, IL (US)

(73) Assignee: LUMINII LLC, Niles, IL (US)

( * ) Notice: Subject to any disclaimer, the term of this patent is extended or adjusted under 35 U.S.C. 154(b) by 0 days.

(21) Appl. No.: 16/541,229

(22) Filed: Aug. 15, 2019

(65) Prior Publication Data

US 2021/0048152 A1 Feb. 18, 2021

(51) Int. Cl.

| | |
|---|---|
| ***F21K 9/275*** | (2016.01) |
| ***F21K 9/69*** | (2016.01) |
| ***F21V 19/02*** | (2006.01) |
| ***F21V 13/04*** | (2006.01) |
| *F21Y 103/10* | (2016.01) |
| *F21Y 115/10* | (2016.01) |

(52) U.S. Cl.

CPC ..... *F21K 9/275* (2016.08); *F21K 9/69* (2016.08); *F21V 13/04* (2013.01); *F21V 19/02* (2013.01); *F21Y 2103/10* (2016.08); *F21Y 2115/10* (2016.08)

(58) Field of Classification Search

CPC . F21K 9/275; F21K 9/69; F21V 13/04; F21V 19/02; F21V 7/05; F21Y 2115/10; F21Y 2103/10; F21S 8/04; F21S 4/28

See application file for complete search history.

(56) References Cited

U.S. PATENT DOCUMENTS

| | | | | |
|---|---|---|---|---|
| 4,949,226 | A * | 8/1990 | Makita | F21S 41/24 362/538 |
| 9,239,142 | B2 * | 1/2016 | Quilici | G02B 6/0035 |
| 2006/0262542 | A1 * | 11/2006 | Ibbitson | F21S 8/022 362/368 |
| 2008/0310177 | A1 * | 12/2008 | Clark | B60Q 3/43 362/471 |
| 2010/0149823 | A1 * | 6/2010 | Happoya | F21K 9/232 362/373 |

(Continued)

*Primary Examiner* — Rajarshi Chakraborty
*Assistant Examiner* — Glenn D Zimmerman
(74) *Attorney, Agent, or Firm* — Saul Ewing Arnstein & Lehr LLP

(57) ABSTRACT

Light systems and light fixtures are described herein. In one embodiment, a light system may include a light fixture, a first diffuser attached to the light fixture, where the first diffuser and the light fixture define a cavity, a first LED producing ambient light within the cavity, and a second LED producing directional light in the cavity, where the first diffuser is adapted or configured to receive the ambient light and the directional light and emit the ambient light and the directional light external to the light system. In another embodiment, a light fixture may include a first LED subsystem including a first LED and a diffuser, the first LED subsystem adapted or configured to produce ambient light, a second LED subsystem including a second LED and a reflector, the second LED subsystem adapted or configured to produce directional light, where the directional light passes through the diffuser.

14 Claims, 21 Drawing Sheets

(56) References Cited

U.S. PATENT DOCUMENTS

| | | | | |
|---|---|---|---|---|
| 2010/0271836 | A1* | 10/2010 | Bakk | F21S 41/151 362/547 |
| 2011/0163681 | A1* | 7/2011 | Dau | H05B 45/00 315/191 |
| 2012/0320626 | A1* | 12/2012 | Quilici | F21S 8/04 362/606 |
| 2014/0254153 | A1* | 9/2014 | Vissenberg | F21V 23/0471 362/235 |
| 2017/0013694 | A1* | 1/2017 | Nakamura | H02H 11/003 |
| 2017/0059108 | A1* | 3/2017 | Hardy | F21S 43/241 |
| 2019/0338148 | A1* | 11/2019 | Maa | C09D 7/67 |
| 2020/0393097 | A1* | 12/2020 | St. Ives | F21V 21/005 |

* cited by examiner

LIGHTING SYSTEM PROVIDING COMBINED DIRECTIONAL AND AMBIENT LIGHT

BACKGROUND OF THE INVENTION

Conventional lighting fixtures focus on providing a single type of light source. For example, some conventional light fixtures may provide for directional lighting, which may provide a directional beam of light from the fixture at a set angle. In another example, conventional lighting fixtures may focus on providing ambient lighting, which may provide a dispersed light throughout an area or room.

Attempts to provide a combination of both directional and ambient lighting in a single fixture have proven ineffective. These combination attempts have essentially provided a single fixture attached to another fixture. For example, a directional light fixture may be attached to the exterior of an ambient light fixture. This configuration, however, fails to be aesthetically pleasing, (e.g., the configuration may provide a haphazard look) such that the configuration is undesirable in either a professional office setting or in residential use. Moreover, if both directional and ambient light ballasts are powered simultaneously, and because these conventional configurations are not originally designed to integrate various light sources, the combined lighting results in an ineffective light pattern such that the combination of lights provide neither sufficient directional lighting nor sufficient ambient lighting.

SUMMARY

A system for providing directional and ambient lighting is described herein. The system may house at least two light sources within a single fixture. One light source may emit directional light, while another light source may emit ambient light. The directional light source and the ambient light source may be housed in a fixture cavity. One side of the fixture cavity may be closed by a diffuser, where the diffuser masks the presence of the directional light source, the ambient light source, or both, when the light sources are not powered. When either of the light sources are powered on, the diffuser acts to mask which of the directional light source, the ambient light source, or both are the source of the emitted light, thereby maintaining the aesthetic qualities of the system as well as the integrity of the light patterns of the emitted light.

One aspect of the invention provides for a light system. In one embodiment, the light system includes a light fixture, a first diffuser or lens attached to the light fixture, where the first diffuser or lens and the light fixture define a cavity, a first LED producing ambient light within the cavity, and a second LED producing directional light in the cavity, where the first diffuser or lens is adapted or configured to receive the ambient light and the directional light and emit the ambient light and the directional light external to the light system.

This aspect of the invention can include a variety of embodiments.

In one embodiment, the first LED further includes a second diffuser or lens configured or adapted to produce the ambient light. In another embodiment, the second LED further includes a second diffuser or lens configured or adapted to produce the directional light. In some cases, the second diffuser or lens includes a light reflector.

In one embodiment, the emitted directional light includes a directional light beam with an angle of less than 60 degrees relative to a transmission surface face of the first diffuser. In another embodiment, the first LED and the second LED are independently operable. In another embodiment, the first LED and the second LED are further configured or adapted to be moved along a length of the light fixture.

In one embodiment, the system further includes a mount connecting the first LED or the second LED to an internal portion of the light fixture. In some cases, the light fixture further includes a socket coupled to the mount of the first LED or the second LED, the mount configured to allow for rotary movement of the first LED or the second LED within the light fixture. In some cases, the mount includes a ball mount, pivot, or means that allow the light to be adjusted.

In one embodiment, the emitted ambient light forms a batwing projection pattern.

One aspect of the invention provides for a light fixture for providing ambient light and directional light. In one embodiment, the light fixture includes a first LED subsystem including a first LED and a diffuser, the first LED subsystem adapted or configured to produce ambient light, a second LED subsystem including a second LED and a reflector, the second LED subsystem adapted or configured to produce directional light, where the directional light passes through the diffuser.

This aspect of the invention can include a variety of embodiments.

In one embodiment, the diffuser includes either a light lens or a light filter. In one embodiment, the diffuser masks the first LED subsystem from a view external to the fixture. In one embodiment, the directional light is directable to an angle relative to a transmission surface face of the diffuser. In one embodiment, the ambient light forms a batwing projection pattern. In one embodiment, the first LED subsystem, the second LED subsystem, or both are moveable along a length of the light fixture.

In one embodiment, the first LED subsystem and the second LED subsystem are independently operable. In one embodiment, the light fixture further includes a linear light source producing light rays in an opposite direction of the emitted ambient light from the first LED subsystem.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views.

DEFINITIONS

The instant invention is most clearly understood with reference to the following definitions.

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Unless specifically stated or obvious from context, the term "or," as used herein, is understood to be inclusive.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

DETAILED DESCRIPTION OF THE INVENTION

Figure 1:
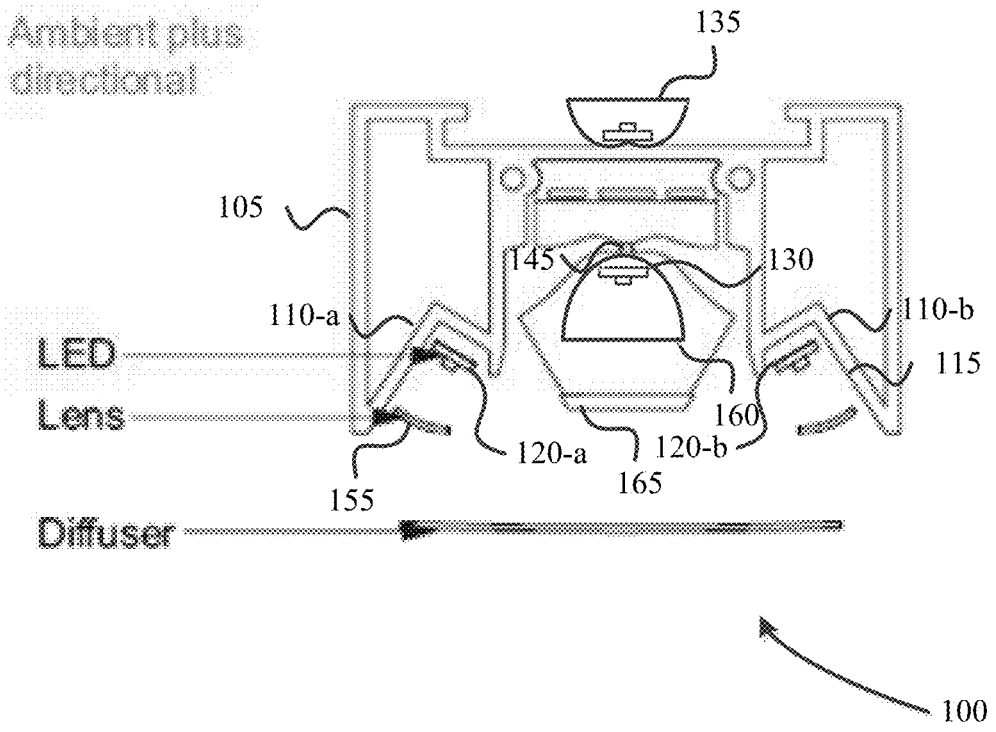
FIGS. 1-6 depict light fixture configurations for ambient and directional lighting, according to embodiments of the claimed invention.

FIG. 1 depicts a system 100 for providing ambient and directional lighting, in accordance with an embodiment of the claimed invention. The system 100 includes a light fixture 105. The light fixture 105 can act as a housing for multiple light sources. For example, the illustrated system 100 provides for four light sources 120-*a*, 120-*b*, 130, and 135 to be housed in the light fixture 105. However, any number of light sources can be housed in the light fixture 105, such as 2 light sources, 3, light sources, 5 light sources, etc.

The light fixture 105 can be composed of a rigid material such as a metal or metal alloy (examples of which include aluminum, cadmium, niobium, copper, gold, iron, nickel, platinum, silver, tantalum, titanium, zinc, zirconium, aluminum, cold rolled steel, stainless steel, brass, and the like), plastics (examples of which include acrylics, polycarbonates, polyethylene, urea formaldehyde, acrylonitrile butadiene styrene, alkyd resins, amino resins, epoxy resins, ethylene vinyl acetate, phenol formaldehyde, polyacetal, polyamide, polyesters, polyethylene, polymethyl methacrylate, polymethyl pentane, polyphenylene oxide, polyphenylene sulphide, polystyrene, polysulphone, polytetrafluoroethene, polyvinyl chloride, styrene acrylonitrile, and the like), or a combination thereof. The light fixture 105 includes a support structure 110-*a* and 110-*b*. The support structure 110-*a* and 110-*b* provides additional rigidity to the light fixture 105, and also assists in forming and maintaining the overall shape of the light fixture 105. In some cases, the support structure 110-*a* and 110-*b* can at least partially form a mounting structure for at least one light source (e.g., support structure 110-*b* forms a mounting structure for an ambient light source 120-*b*). Additionally, the support structure 110-*a* and 110-*b* can also assist in guiding emitted light from at least one light source of the system 100. For example, the support structure 110-*b* can include a reflecting surface 115, where light emitted from an ambient light source 120-*b* reflects off (e.g., is directed by) the reflecting surface towards a bottom opening of the light fixture 105. In other cases, the support structures 110-*a* and 110-*b* can include an absorbing surface, where light emitted from a light source is absorbed by the absorbing surface, thereby decreasing the intensity of the emitted light. In either case, the surface of the support structures 110-*a* and 110-*b* can be used to manipulate the emitted light, subsequently affecting the emitted light intensity and/or the direction (e.g., a light pattern) of the emitted light as described in more detail below.

The light fixture 105 can house several different types of light sources. For example, the light fixture 105 can house at least one directional light source, such as directional light source 130, and at least one ambient light source, such as ambient light source 120-*a*. In some cases, the light fixture 105 can also house at least one up-light source, such as up-light source 135. As shown in FIG. 1, the light fixture 105 includes the directional light source 130, ambient light sources 120-*a* and 120-*b*, and the up-light source 135.

The ambient light sources 120-*a* and 120-*b* can be the source of ambient lighting from the system 100. For example, the ambient light sources 120-*a* and 120-*b* can include a light producing element such as a bulb, or light emitting diode configured to produce ambient lighting. In some cases, the ambient light sources 120-*a* and 120-*b* can include a diffuser or lens (e.g., lens 155) configured to produce ambient lighting from a light producing element. In some cases, the emitted light from the ambient light sources 120-*a* and 120-*b* is converted from directional light emitted by the light producing element to ambient light through the use of a diffuser 140, which will be discussed in more detail below.

The directional light source 130 can be a source of directional lighting from the system 100. For example, the directional light source 130 can include a light producing element such as a bulb or LED configured to produce directional lighting. In some cases, the directional light source 130 can include a diffuser, reflector, or lens configured to produce directional light from a light producing element. In some cases, the emitted light from the directional light source 130 is converted from ambient light to directional light through the use of diffuser 140. Further, either a reflector or lens 160, or a light shaping element 165, or both, can receive light from the light source 130, and can alter or modify the emitted light from the directional light source 130 prior to the diffuser receiving the light.

The directional light source 130 can be coupled to a repositionable structure 145 in the cavity of the light fixture 105. The repositionable structure 145 can be used to reposition the directional light source 130, thereby changing the position or angle of projection of the directional light from the system 100. For purpose of example only, in some cases the repositionable structure 145 can be a ball-and-mount system that allows for rotary movement by the directional light source 130 (e.g., up to 180 degrees of rotation) as shown in FIG. 1. In other examples, the repositionable structure 145 can be a slide track system allowing for lateral movement of the directional light source 130. The repositionable structure 145 allows a user to manually direct the light from the directional light source 130 towards a desired location (e.g., at an art piece hanging on a wall) and can be any structure that allows this capability.

The up-light source 135 can provide for a light emission in a generally opposite direction to that of the direction of light emission from the directional and ambient lighting of the system 100. For example, the up-light source 135 as shown in FIG. 1 faces the upwards directions, whereas the ambient light sources 120-*a* and 120-*b* and the directional light source 130 are generally facing the down direction. The light emission from the up-light source 135 can be emitted above the system 100 and projected onto a mounting surface, such as a ceiling. The emitted light from the up-light source 135 can either be dispersed by hitting the mounting surface, lens, or reflector, or project a light pattern onto the mounting surface, or a combination thereof. In some cases, the up-light source 135 is housed in a recess of the light fixture 105. The structural design of the recess can manipulate the intensity, direction, or pattern of the emitted light from the up-light source 135. For example, the recess can be formed by support structures 150 similar to support structures 110-*a* and 110-*b*, where the support structures 150 shape the area of the recess. The support structures 150 can be used to absorb or reflect the emitted light from the up-light source 135, thereby manipulating the light emitted from the system 100. Additionally or alternatively, the up-light source 135 can include a light producing element such as a bulb, an LED, or the like, configured to produce up-lighting. In some cases, the up-light source 135 can include a diffuser or lens configured to produce up-lighting from a light producing element.

The diffuser 140 can be coupled to the light fixture 105 to form an enclosed cavity in which the ambient light sources 120-*a* and 120-*b* and the directional light source 130 are positioned. In some cases, the diffuser 140 can be a lens or a filter. The diffuser 140 can be positioned to receive light emitted from the ambient light sources 120-*a* and 120-*b*, the directional light source 130, or a combination thereof. When passing through the diffuser 140, the light emitted from the ambient light sources 120-*a* and 120-*b* can be changed and/or altered and further emitted from the light fixture 105 as ambient lighting. In some cases, the ambient light emitted from the diffuser 140 can have a light intensity that is reduced relative to the light intensity of the light received by the diffuser 140 from the ambient light sources 120-*a* and 120-*b*. In some cases, the diffuser 140 can also alter a transmission angle and/or a beam width angle of the light emitted from the ambient light sources 120-*a* and 120-*b*.

The light emitted from the directional light source 130 can also be altered by the diffuser 140. For example, when passing through the diffuser 140, the light emitted from the directional light source 130 can be changed and/or altered and transmitted from the light fixture 105 as directional lighting. In some cases, the intensity of directional light transmitted from the diffuser 140 is reduced relative to the intensity of light emitted from the directional light source 130. In some cases, the diffuser 140 can alter a transmission angle and/or a beam width angle of the directional light emitted from the directional light source 130. However, the directional light transmitted from the diffuser 140 can still retain some directional lighting characteristics, such as a transmission angle or beam width angle at or less than 60 degrees. In another example, the transmission angle or beam width angle can be less than 90 degrees.

The practical effect of the diffuser 140 is to mask the identity of the light sources housed in the fixture 105 from an external perspective to the system 100, while still maintaining the characteristics of the different types of light emitted from those light sources within the system 100. In an exemplary embodiment, the light fixture 105 is attached (e.g., mounted) onto a ceiling of a room. From a viewer's perspective (e.g., a below perspective), the viewer can view the underside of the system 100, (e.g., a user primarily views the diffuser 140 coupled to the light fixture 105). When all of the lights are turned off in the system 100, the viewer sees only the diffuser 140, which masks the presence of the ambient light sources 120-*a* and 120-*b* and the directional light source 130. When the ambient light sources 120-*a* and 120-*b* are turned on, the diffuser 140 transmits ambient light in a predetermined projection pattern, such as a batwing profile pattern. The predetermined projection pattern can be based on multiple factors, including the angle of emission from the ambient light sources 120-*a* and 120-*b*, any lenses or diffusers coupled to the ambient light sources 120-*a* and 120-*b*, the positioning of the directional light source 130, the shape of the cavity of the light fixture 105, and the like. However, the diffuser still obscures the source of the transmitted ambient lighting (e.g., the ambient light sources 120-*a* and 120-*b*).

When the directional light source 130 is turned on, the diffuser 140 transmits directional light from the system 100. However, the diffuser 140 continues to mask the directional light source 130 from an external view. Further, in some cases, the diffuser 140 can also mask the angle of transmission for the emitted light from the directional light source 130. For example, a viewer may simply observe the end point for the directional light, such as directional light projected on a wall (e.g., highlighting an art piece on the wall, etc.). Thus, the viewer may not identify the system as the source of the projected directional light.

The diffuser can in some cases project nonuniform light from the system. For example, the diffuser can include a nonuniform pattern, etching, texture, etc., along its surface. Light received by the diffuser can (e.g., which can be uniform) then project the light based on the surface of the diffuser. These differences can affect the light differently, such that the projected light can include a nonuniform projection pattern, light intensity, transmission angle, etc.

The system can also implement dynamic lighting. Dynamic light can include, as examples, light dimming, changing colors of the light, multiple tracks with different channel, a reallocation of power between different light sources, an adjustment of light color a light source, or a combination thereof.

Figure 2:
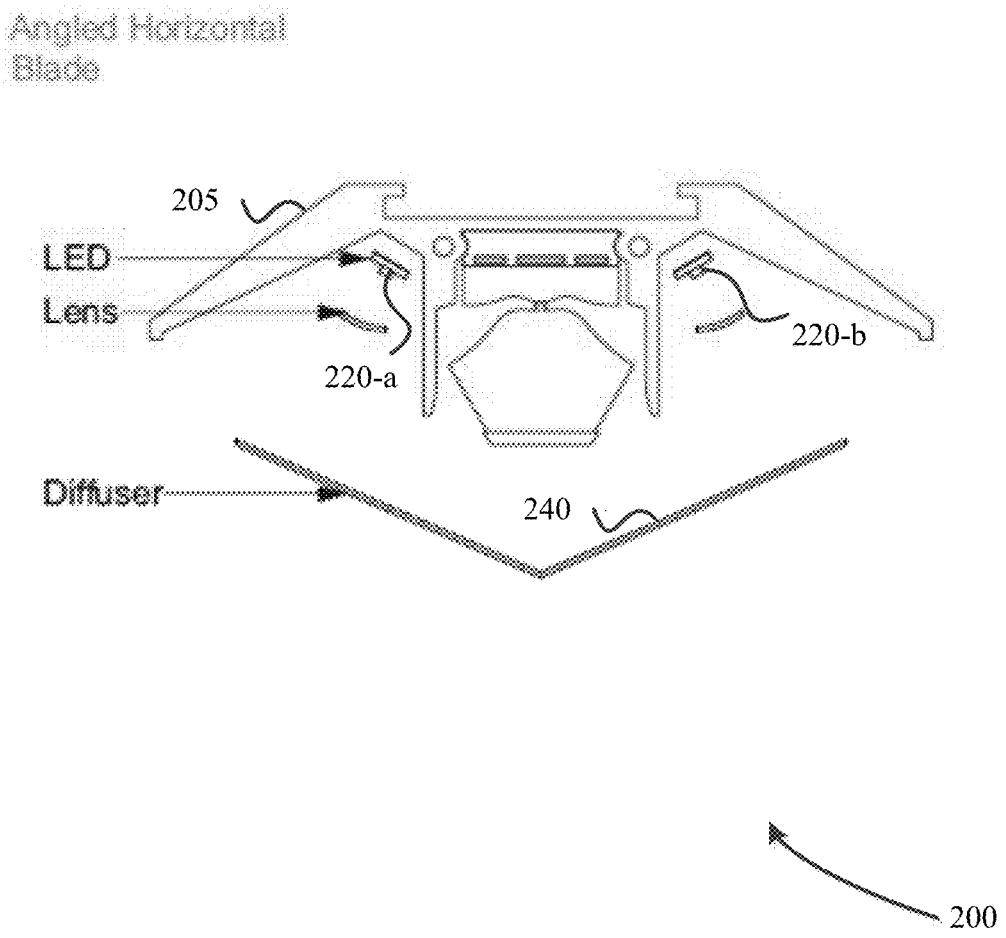
Figure 3:
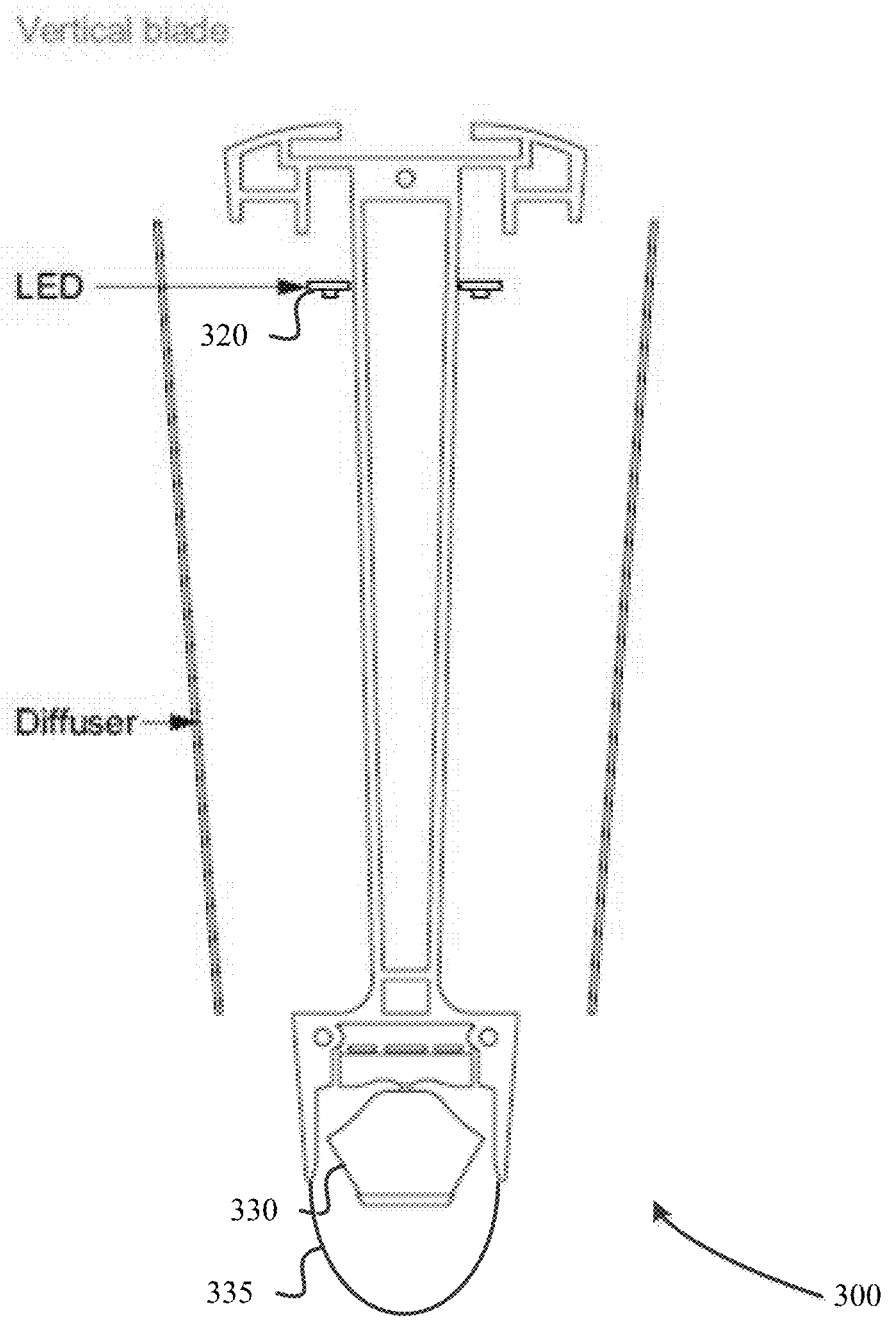
Figure 4:
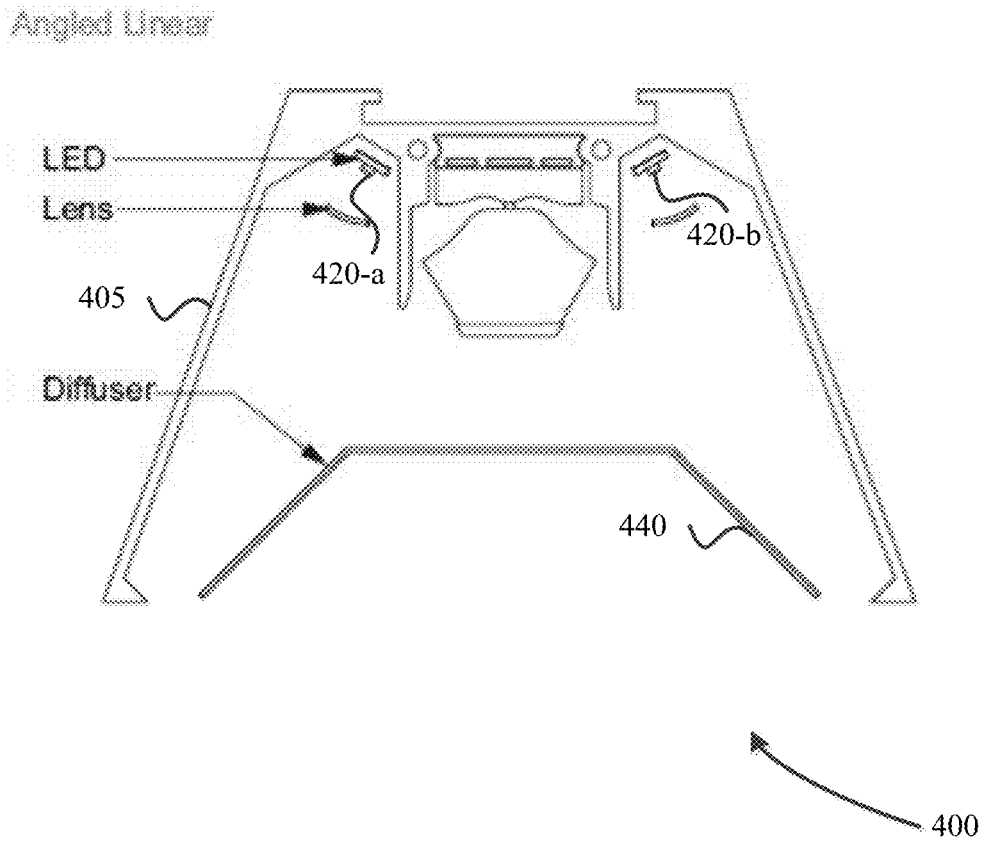
Figure 5:
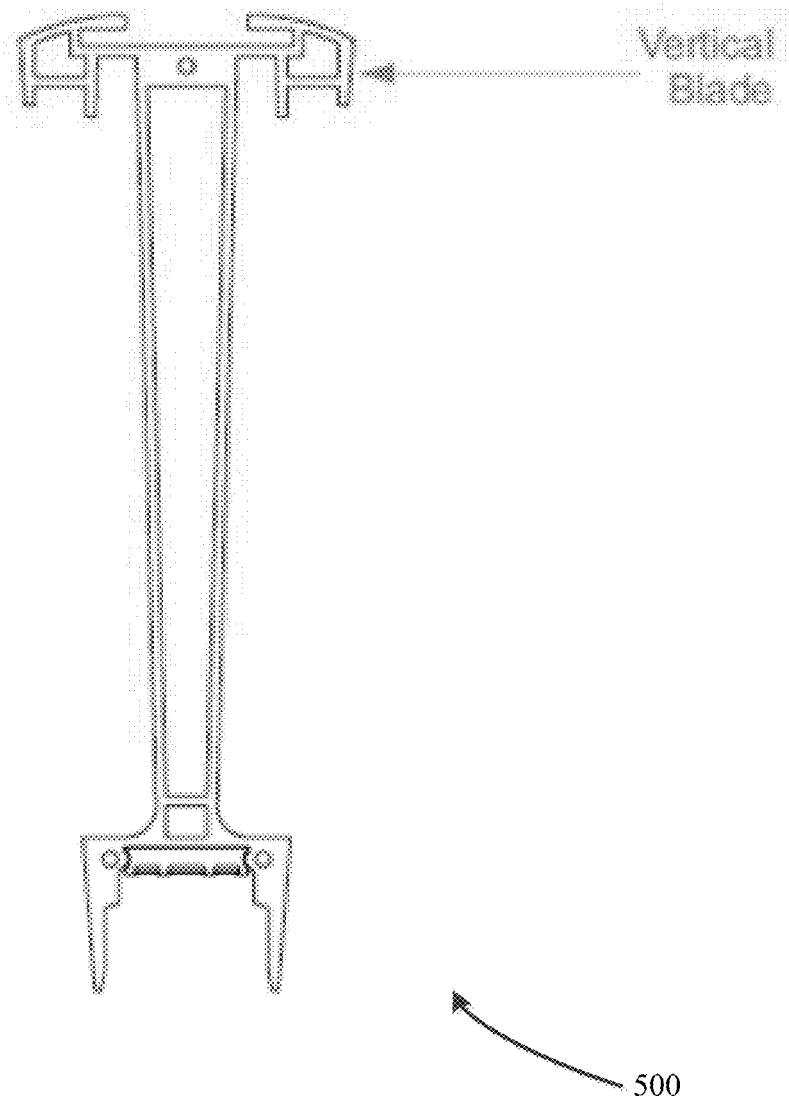
Figure 6:
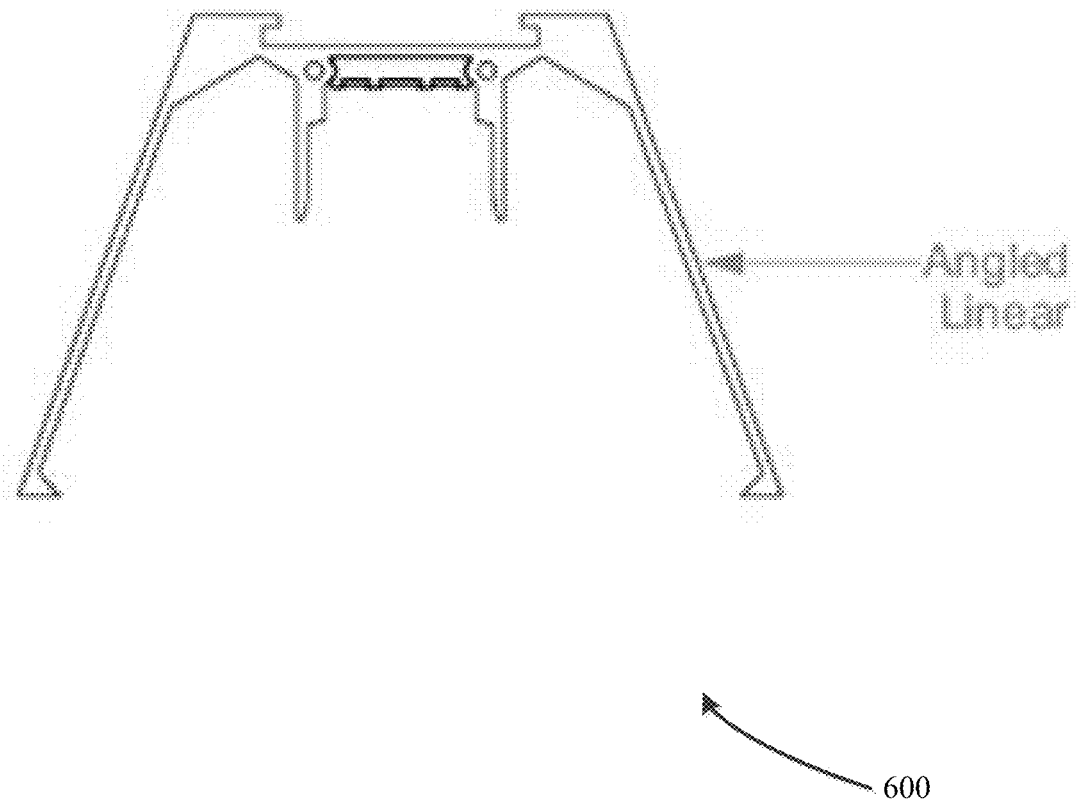
Figure 7:
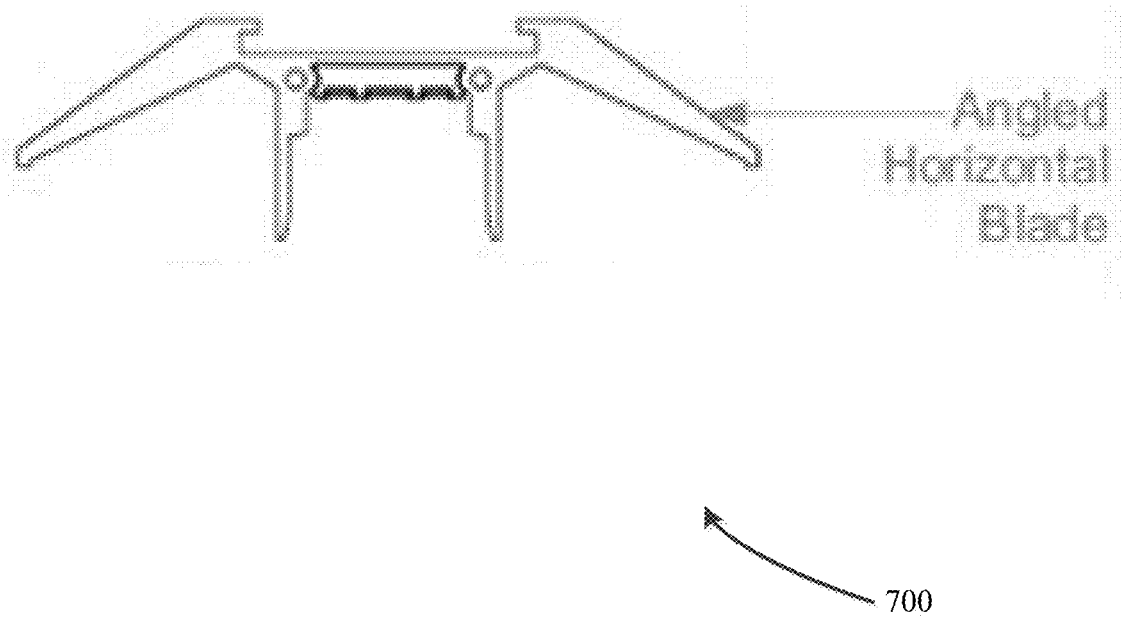
FIG. 7 depicts a head and body configuration for ambient and directional lighting, according to an embodiment of the claimed invention.
Figure 8:
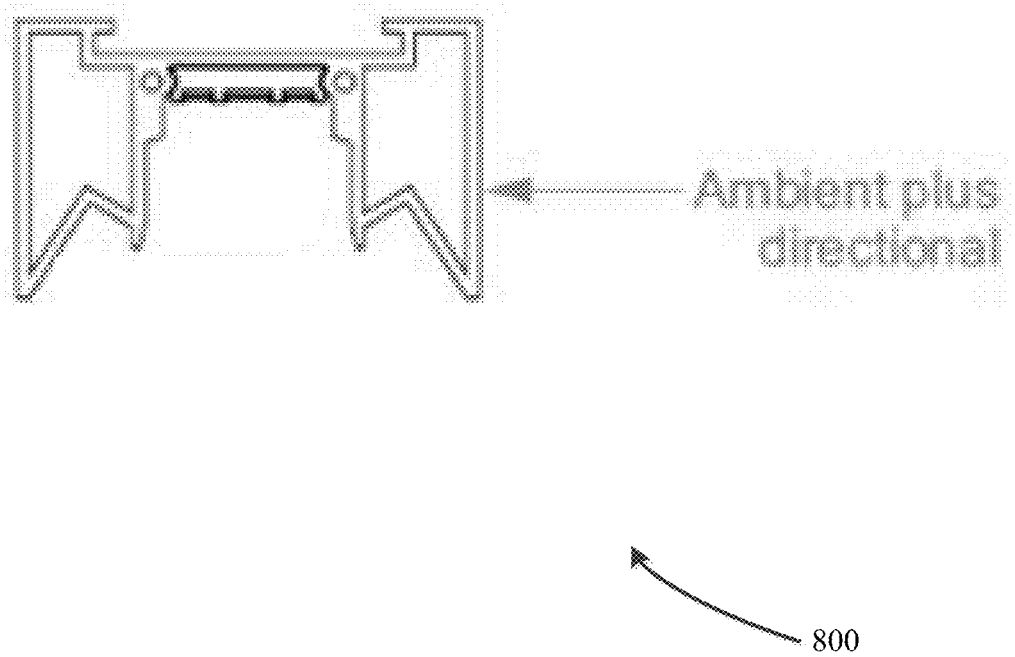
FIGS. 8-11 depict light system configurations for ambient and directional lighting, according to embodiments of the claimed invention.
Figure 9:
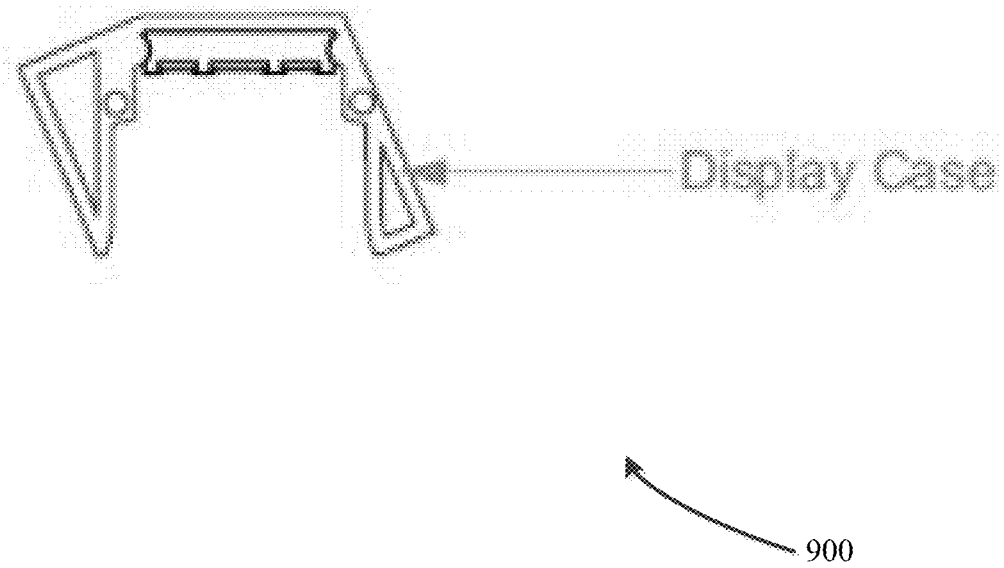
Figure 10:
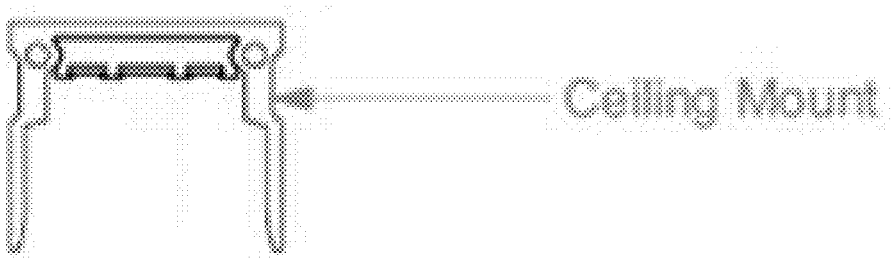
Figure 10:
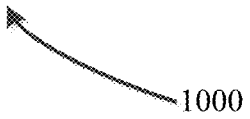

The system, as discussed previously, can be in various shapes and sizes. FIGS. 2-4 provide for alternative embodiments of the system (e.g., systems 200, 300, and 400). In FIG. 2, the system 200 provides for a light fixture 205 shaped as an "angled horizontal blade." In this embodiment, the system 200 can include a single diffuser 240, or multiple diffusers (e.g., two) to form the blade design shown. One benefit of this design is to allow for a batwing profile of emitted light from the ambient light sources (e.g., ambient light sources 220-*a* and 220-*b*) of the system 200.

FIG. 3 provides for a system 300 configured in the shape of a "vertical blade" design. The system 300 can provide for a cavity to house ambient light sources (e.g., ambient light source 320) and a separate cavity for directional light sources (e.g., directional light source 330). One benefit of this design is the minimization of light pattern interference between the ambient and directional lights due to the separated cavities. The system 300 can also include an optional lens or diffuser 335.

FIG. 4 provides for a system 400 configured in the shape of "angled linear" design. In this embodiment, the system 400 can include a single diffuser 440, or multiple diffusers (e.g., three) to form the angled design shown. One benefit of this design is to allow for a linear profile of ambient light to be emitted from the light fixture 405 (e.g., from ambient light sources 420-*a* and 420-*b*).

Various types of light sources can be used in the systems 100-400. For example, an exemplary embodiment provides for LED lighting, laser lighting, and/or fiber optic lighting as the light sources for the ambient/directional/up-lighting lighting sources. However, the systems 100-400 can also include incandescent light, compact fluorescent (CFL) light, halogen light, metal halide light, high pressure sodium (HPS) light, low pressure sodium (LPS) light, phosphor-converted amber (PCA) light, narrow-band amber (NBA) light, or a combination thereof.

Although not shown in FIGS. 1-4, systems 100-400 can also include wiring to couple the various light sources to a power source. In some cases, one of more of the light sources can be wired together in series or in parallel to receive power, such as a connections to a main power source. In some cases, the various light sources can be wired independently from one another, thereby allowing for each light source to be independently operable (e.g., can be turned on or off individually). In some cases, the systems 100-400 can be connected to a battery source in lieu of, or in addition to, a main power source. Additionally or alternatively, the systems 100-400 can include a short-range wireless communication system (e.g., a wireless local area network (WLAN) receiver), that allows for the light sources to be operated wirelessly.

As can be seen, FIGS. 1-4 provide two-dimensional cross-section views of the systems 100-400. Although not shown, the depth of the systems 100-400 can vary based on different requirements for the systems 100-400. For example, in some cases the systems 100-400 can include a depth sufficient to house the ambient light sources, directional light sources, and up-light sources. However, in other cases, the depth of the systems 100-400 can be significantly greater. In these cases, the systems 100-400 can include multiple directional light sources, multiple ambient light sources, multiple up-light sources, or a combination thereof, along the depth (e.g., the z) axis. As an example, an elongated version of the system 100 can be used to span the length or width of a room, where a single light fixture houses a multitude of light sources. Additionally, any or all of the light sources can be coupled to a tracking system within the light fixtures 105-405, allowing for any of the connected light sources to be repositioned along the depth direction of the systems 100-400. The directional light can be magnetically held and can be interchangeable, adjusted, etc.

Further, many of the aspects of the systems 100-400 can be interchangeable. For example, the light sources, the lens, the diffusers, or a combination thereof, can be removed, replaced, or interchanged, from the systems 100-400. This interchangeability may allow for a user to format any of the systems 100-400 based on user preferences or lighting requirements.

FIGS. 5-10 illustrate various configurations for a light fixture according to embodiments of the claimed invention. The light fixtures 500-1000 can be examples of light fixtures 105-405 as discussed with reference to FIGS. 1-4, respectively.

Figure 11:
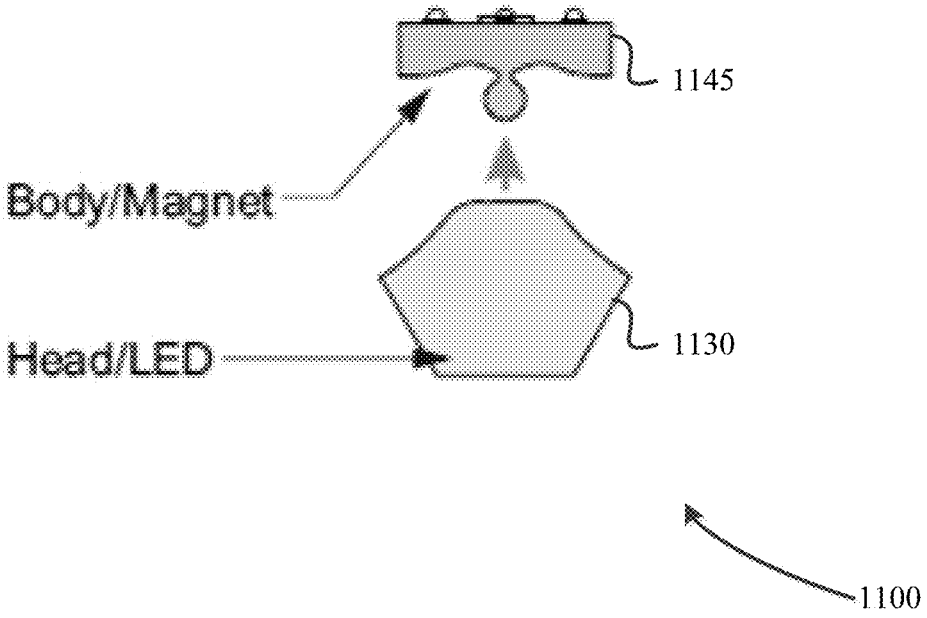
Figure 12:
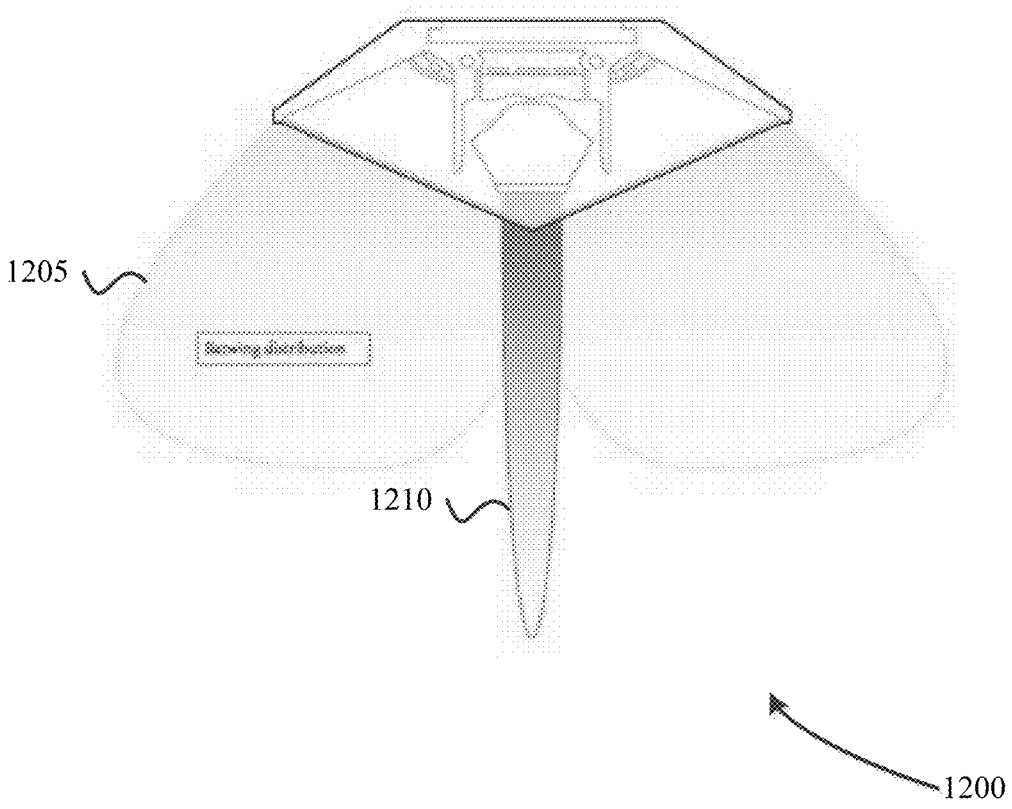
FIGS. 12-15 depict light projection patterns for ambient and directional lighting, according to embodiments of the claimed invention.
Figure 13:
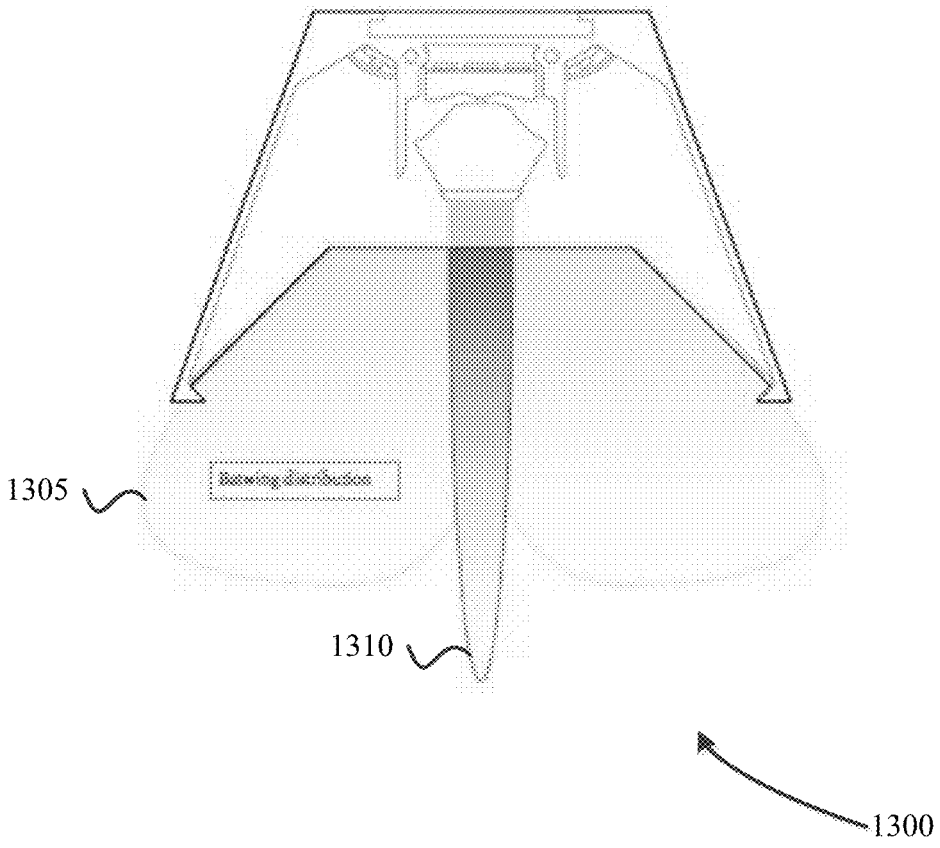
Figure 14:
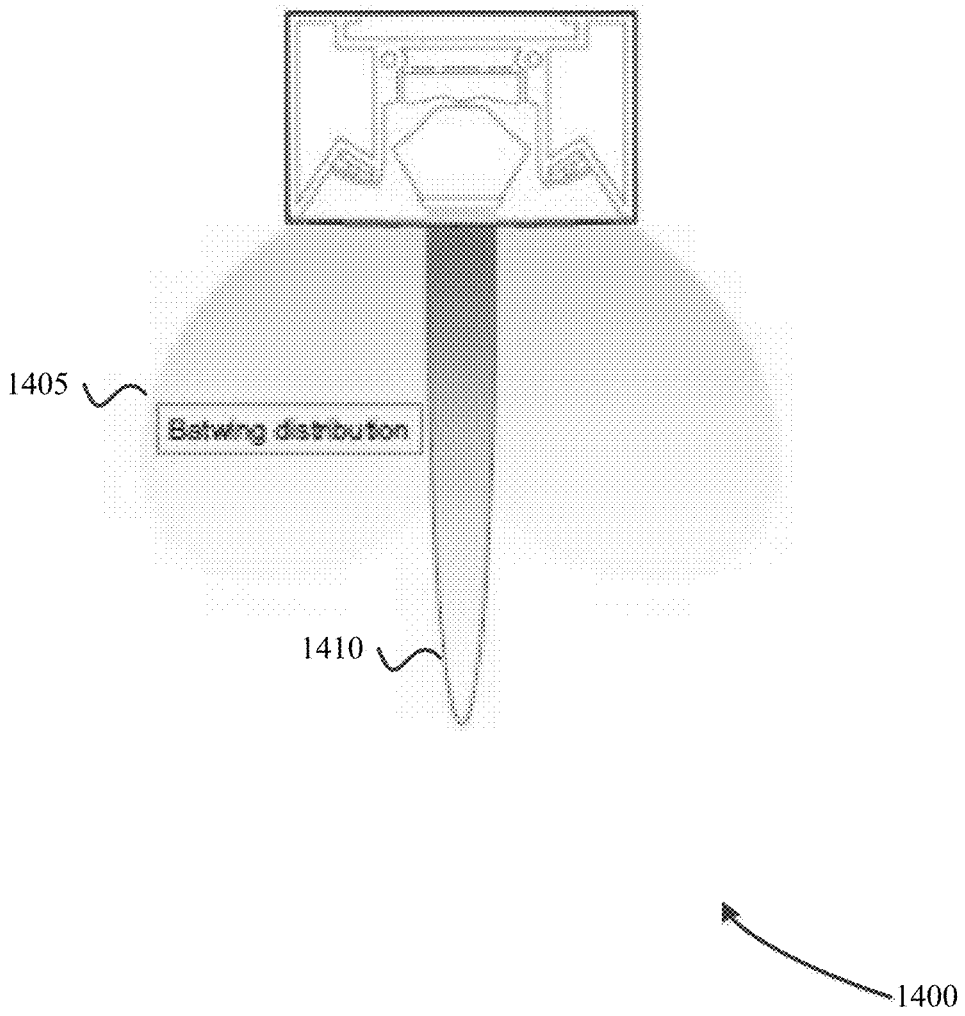
Figure 15:
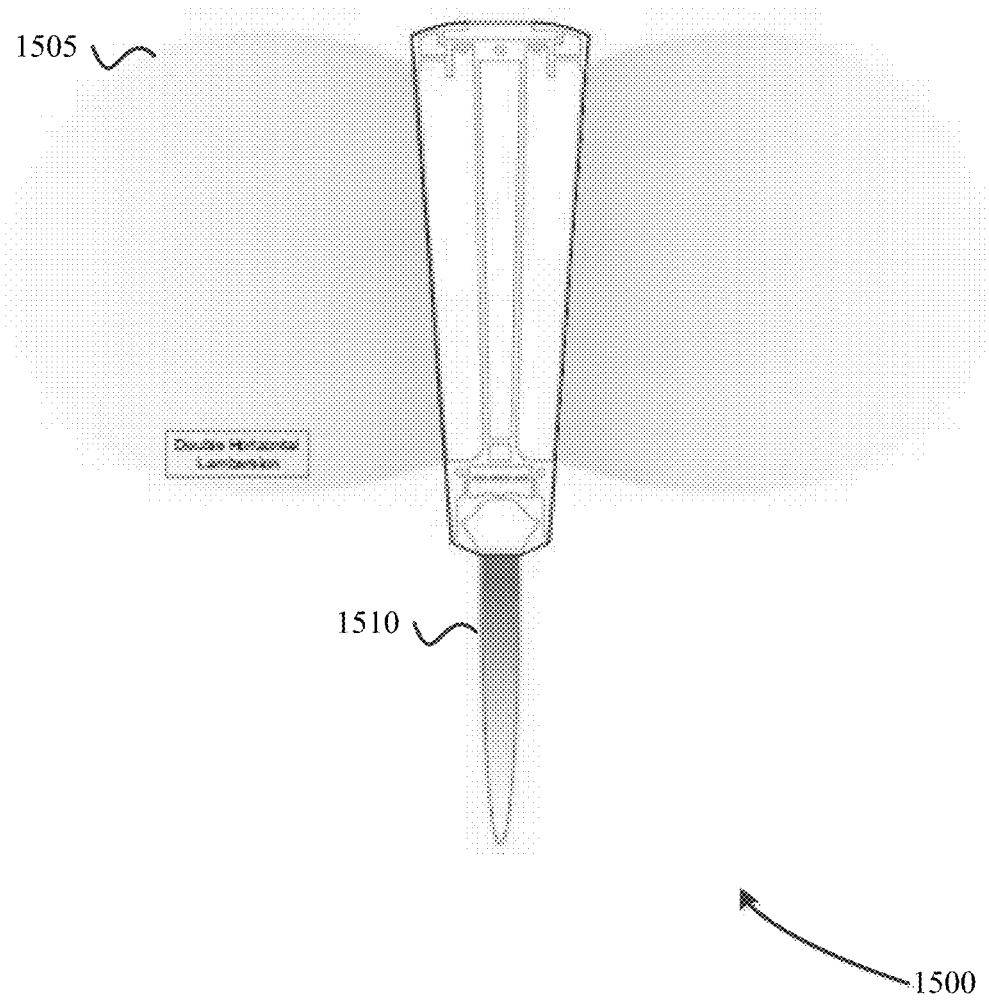
Figure 16:
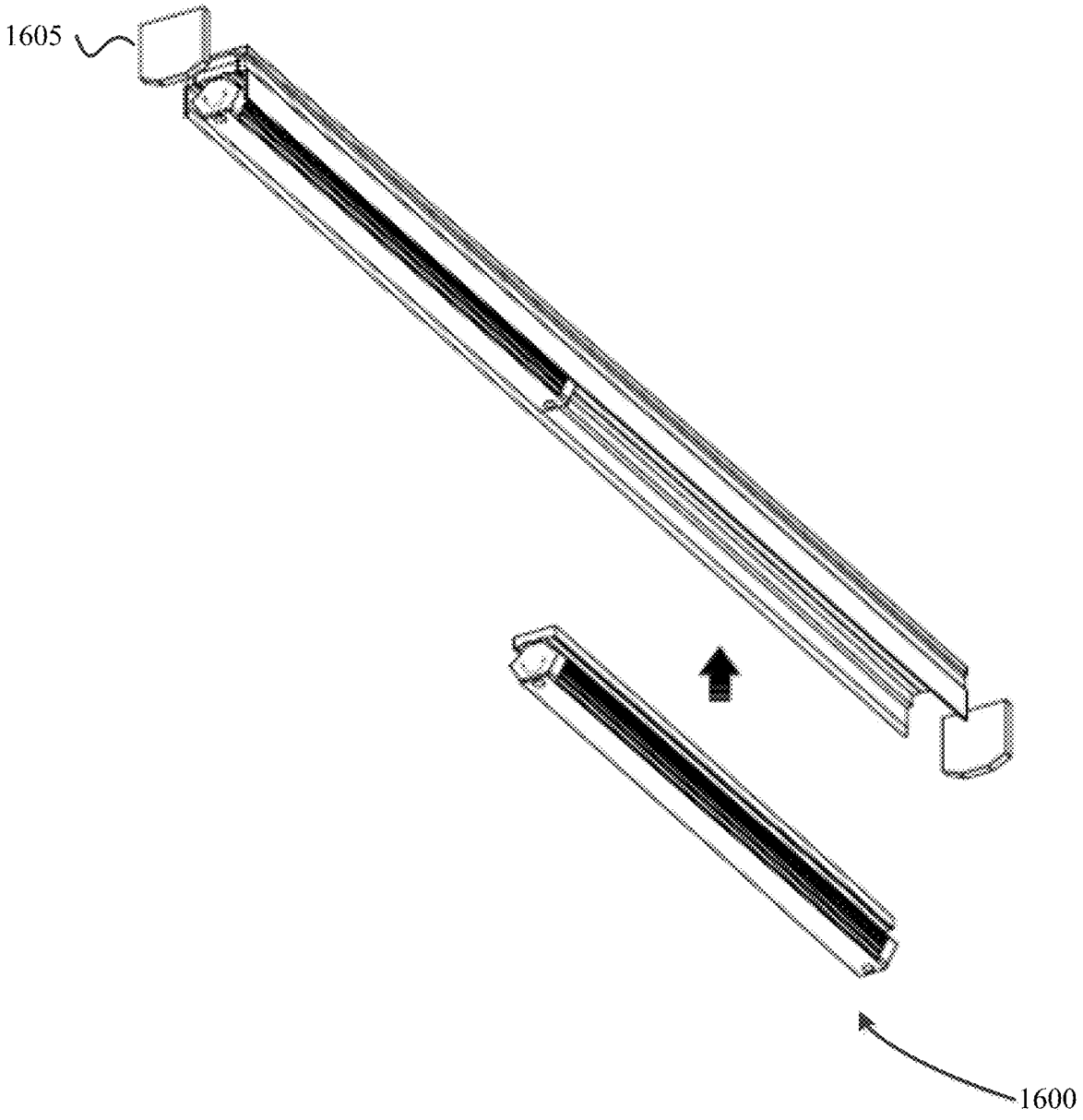
FIGS. 16-21 depict mounting configurations for systems of ambient and directional lighting, according to embodiments of the claimed invention.
Figure 17:
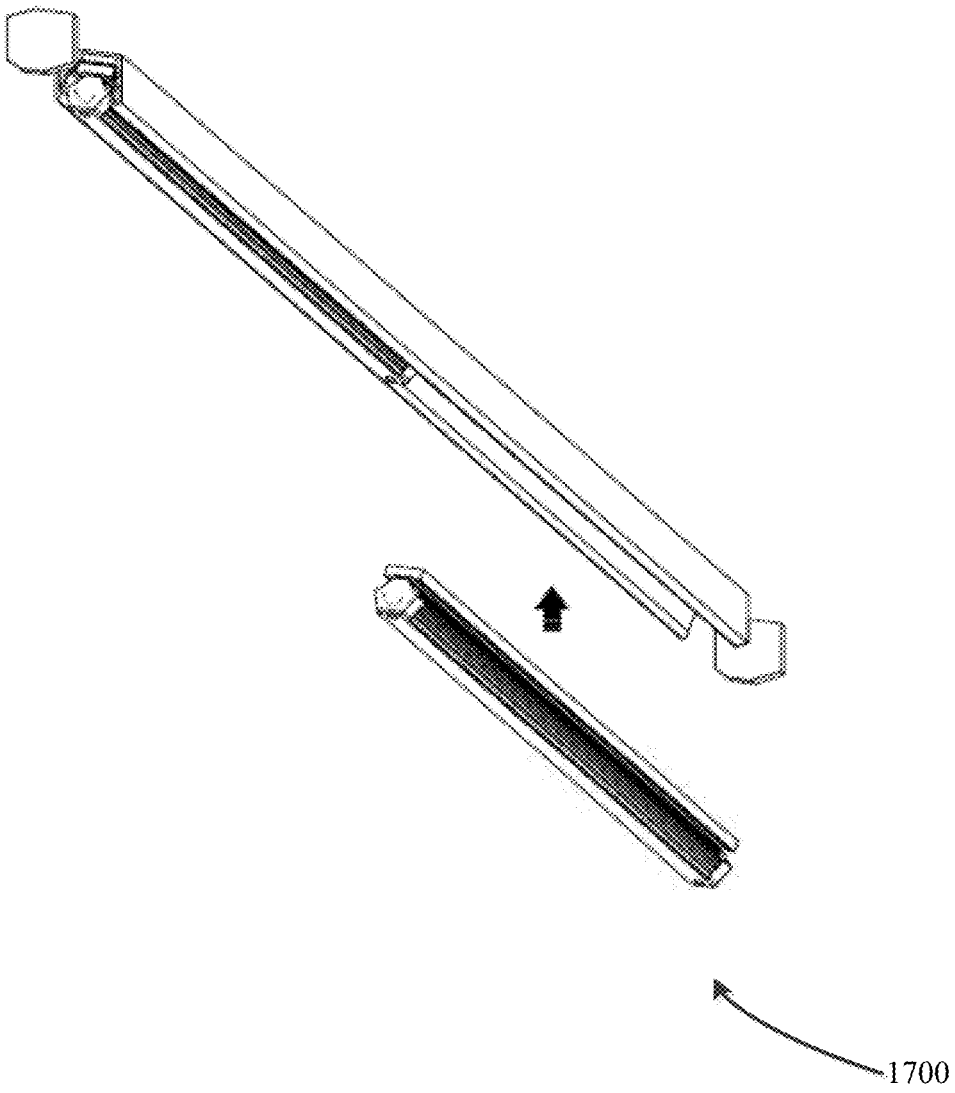
Figure 18:
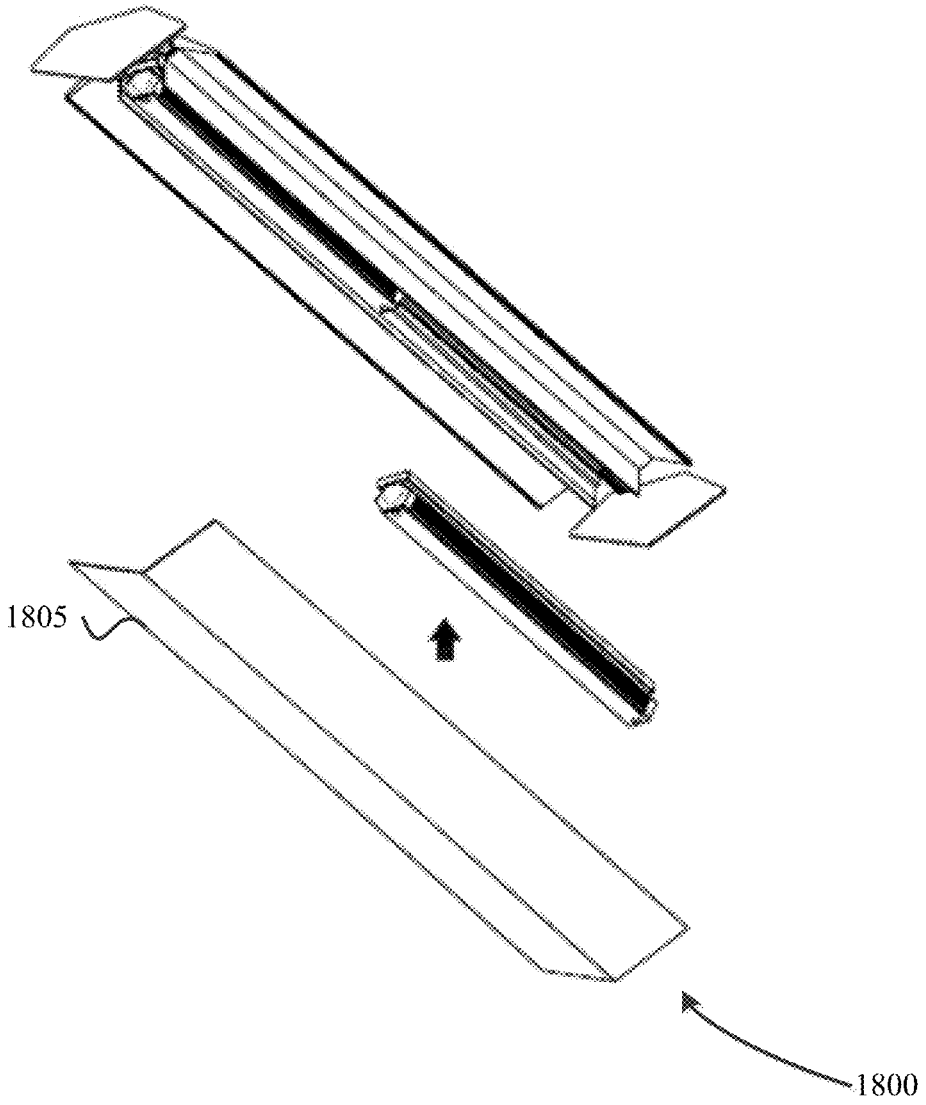
Figure 19:
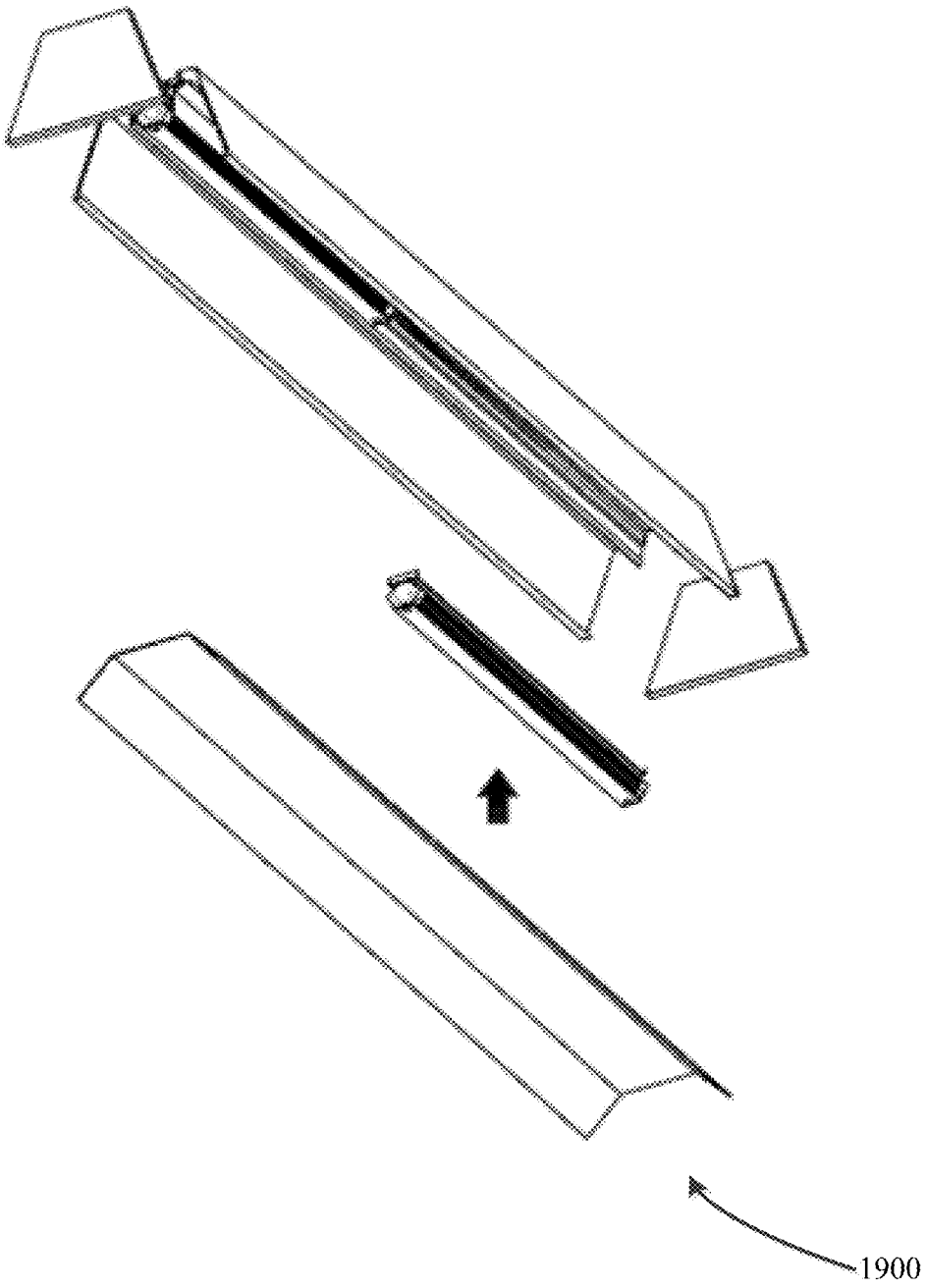
Figure 20:
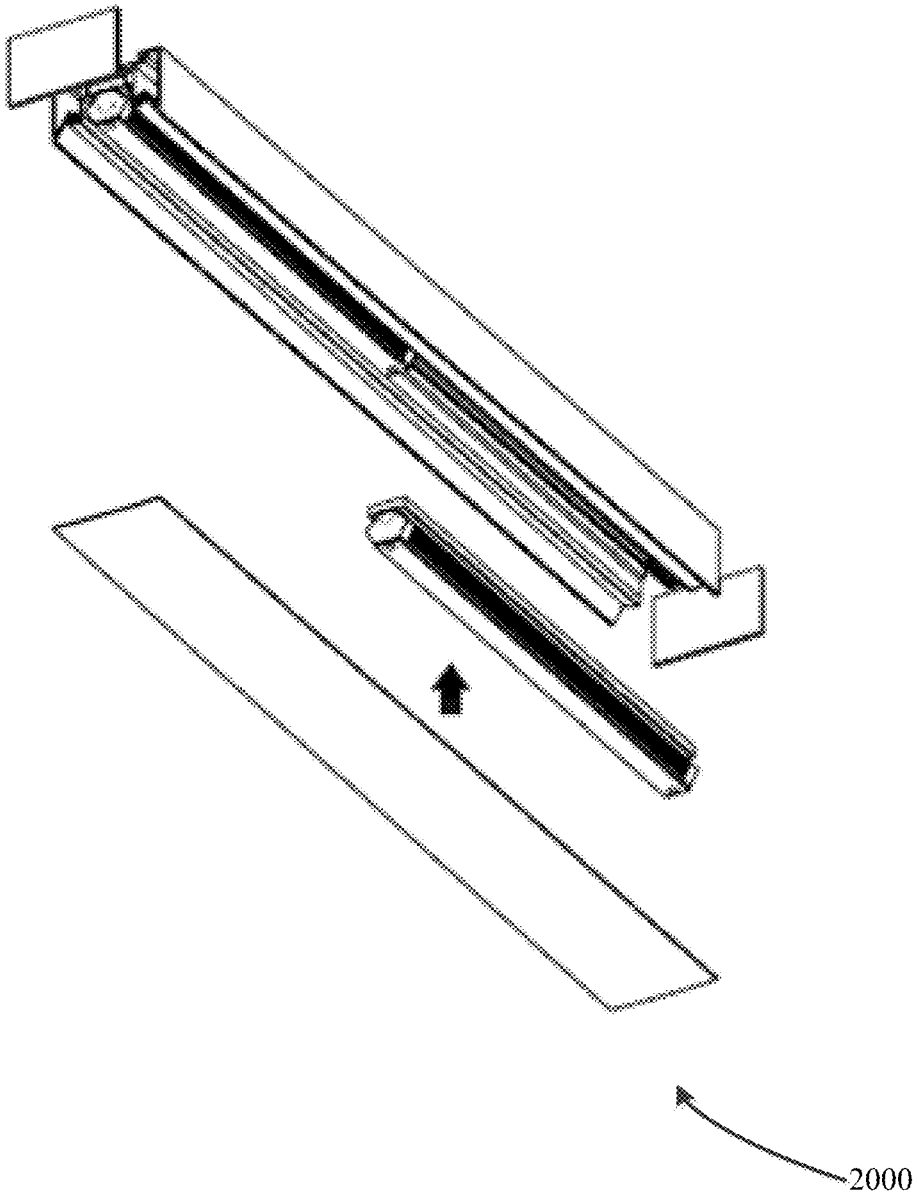
Figure 21:
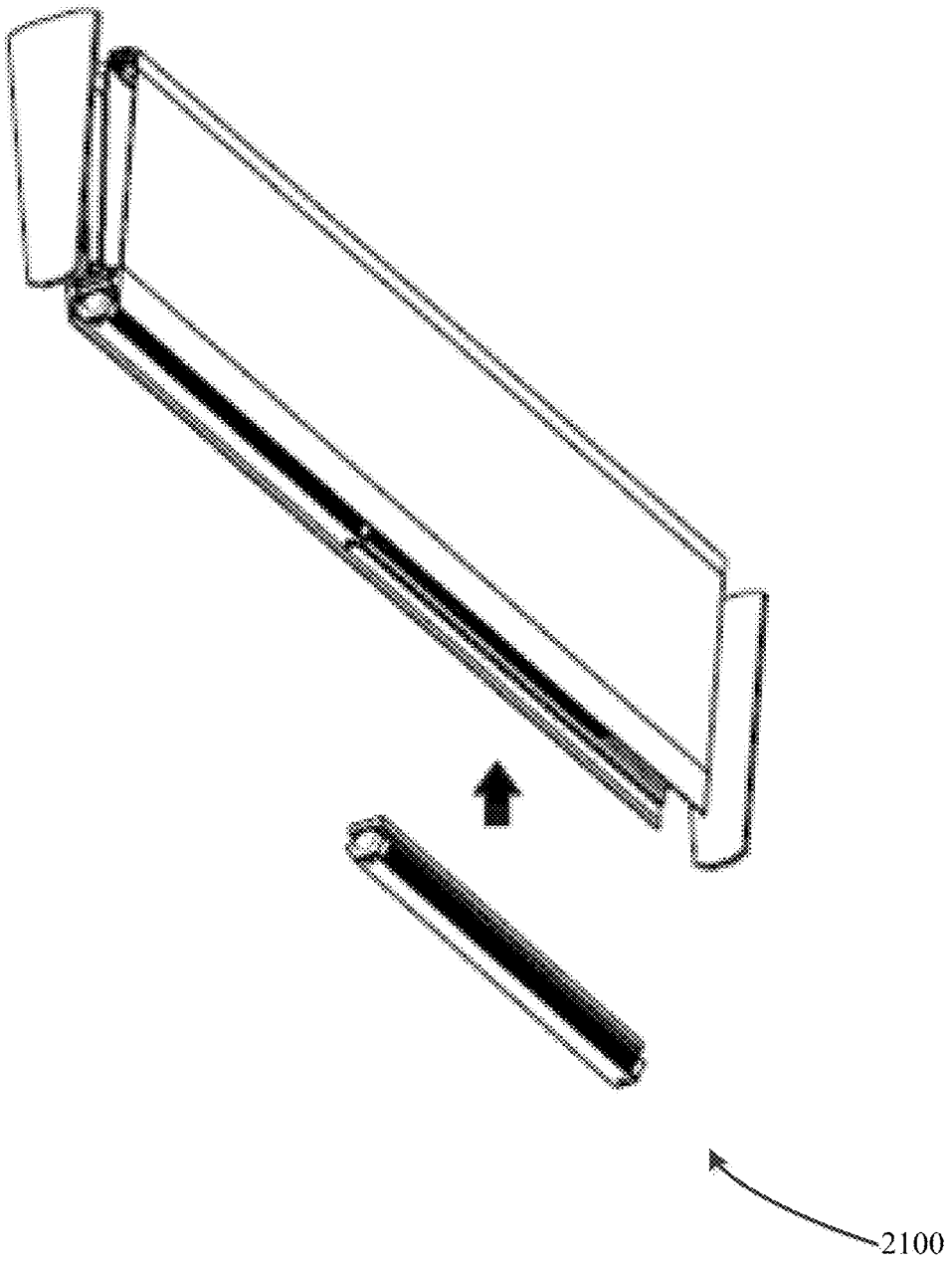

FIG. 11 illustrates a body and head configuration 1100 for use in conjunction with a fixture. For example, the body and head configuration 1100 can be used with any of the fixture configurations 500-1000 as illustrated in FIGS. 5-10, respectively. In some cases, the head 1130 can be an example of the directional light source 130 or 330 as described in more detail with reference to FIGS. 1 and 3, respectively. In some cases, the body 1145 can be an example of the repositionable structure 145 as discussed in more detail with reference to FIG. 1. As shown, the head 1130 can attach to the body 1145 (e.g., via the use of a ball-and-mount system, magnetics, etc.).

As discussed above, the shape and design of the light fixture can be selected based on user preferences and/or environmental needs. Additionally or alternatively, the different light fixture configurations can provide for different light patterns to be projected from the systems. FIGS. 12-15 illustrate different light patterns projected from a light system, such as light systems 100-400 as described in FIGS. 1-4, respectively. Each light pattern can include an ambient light pattern 1205-1505 and a directional light pattern 1210-1510. The ambient light patterns 1205-1505 can vary based on the type of light fixture used in the light system. For example, the horizontal profile of the ambient light 1505 can be partially attributed to shape of the vertical blade design of the utilized light system.

FIGS. 16-21 depict mounting configurations 1600-2100 for the light system, according to embodiments of the claimed invention. One or more light systems can be mounted onto the mounting configurations 1600-2100, such as light systems 100-400 as described with reference to FIGS. 1-4. As discussed in more detail above, the mounting configurations 1600-2100 can include a different technologies to attach to the light systems, such as a magnetic track, a slide track etc., and can provide power to attached light systems (e.g., through male-female connectors). Additionally, the mounting configurations 1600-2100 can include end caps (e.g., end caps 1605) for securing any attached light systems to the mount configuration. In some cases, a diffuser or lens (e.g., diffuser 1805) discussed in more detail above can be attached to the mounting configuration or the attached light system, which may further secure the light system to the mounting configuration.

EQUIVALENTS

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications, and other references cited herein are hereby expressly incorporated herein in their entireties by reference.

The invention claimed is:

1. A light system, comprising:

a linear light fixture;

a first diffuser attached to the light linear fixture, wherein the first diffuser and the linear light fixture define a cavity and the first diffuser can be removed, replaced, or interchanged from the linear light fixture;

a first LED producing ambient light within the cavity, the first LED comprising a second diffuser configured or adapted to produce the ambient light; and a second LED producing directional light in the cavity, the second LED comprising a lens configured or adapted to produce the directional light;

wherein the first diffuser is adapted or configured to receive the ambient light and the directional light and produce the ambient light and the directional light external to the light system, the first diffuser masking the first LED and the second LED from a view external to the light system when the first LED and the second LED are not powered; and wherein the second LED is coupled to a repositionable structure in the cavity, the second LED being repositionable to change a position or angle of projection of the directional light.

2. The light system of claim 1, wherein the second LED comprises a light reflector.

3. The light system of claim 1, wherein the emitted directional light comprises a directional light beam with an angle of less than 60 degrees relative to a transmission surface face of the first diffuser.

4. The light system of claim 1, wherein the first LED and the second LED are independently operable.

5. The light system of claim 1, wherein the linear light fixture further comprises a socket coupled to the repositionable structure of the second LED, the repositionable structure configured to allow for rotary movement of the second LED within the linear light fixture.

6. The light system of claim 1, wherein the repositionable structure comprises a ball mount or a pivot.

7. The light system of claim 1, wherein the ambient light forms a batwing projection pattern.

8. The light system of claim 1, wherein selected areas of the first diffuser emit the light differently compared to other areas of the first diffuser or lens.

9. A linear light fixture for providing ambient light and directional light, the linear light fixture comprising:

a first LED subsystem comprising a first LED and a diffuser, the first LED subsystem adapted or configured to produce ambient light;

a second LED subsystem comprising a second LED and a reflector, the second LED subsystem adapted or configured to produce directional light;

wherein the directional light passes through the diffuser and the diffuser masks the first LED and the second LED from a view external to the linear light fixture when the first LED and the second LED are not powered;

wherein the diffuser can be removed, replaced, or interchanged from the linear light fixture; and wherein the second LED subsystem is coupled to a repositionable structure in an internal portion of the linear light fixture, the second LED being repositionable to change a position or angle of projection of the directional light.

10. The light fixture of claim 9, wherein the diffuser comprises either a light lens or a light filter.

11. The linear light fixture of claim 9, wherein the directional light is directable to an angle relative to a transmission surface face of the diffuser.

12. The linear light fixture of claim 9, wherein the ambient light forms a batwing projection pattern.

13. The linear light fixture of claim 9, wherein the first LED subsystem and the second LED subsystem are independently operable.

14. The light linear fixture of claim 9, further comprising:

a linear light source producing light rays in an opposite direction of the emitted ambient light from the first LED subsystem.

* * * * *